US008152343B2

(12) United States Patent
Savage et al.

(10) Patent No.: US 8,152,343 B2
(45) Date of Patent: Apr. 10, 2012

(54) LAMPS AND HARP ADAPTOR APPARATUSES FOR USE WITH LOOP LIGHT SHADES

(76) Inventors: M. Simone Savage, Hayden Lake, ID (US); Randy L. Mikels, Hayden Lake, ID (US)

( * ) Notice: Subject to any disclaimer, the term of this patent is extended or adjusted under 35 U.S.C. 154(b) by 240 days.

(21) Appl. No.: 12/460,392

(22) Filed: Jul. 16, 2009

(65) Prior Publication Data

US 2010/0014300 A1 Jan. 21, 2010

Related U.S. Application Data

(60) Provisional application No. 61/135,065, filed on Jul. 16, 2008.

(51) Int. Cl.
*F21V 17/00* (2006.01)

(52) U.S. Cl. ..... 362/417; 362/410; 362/412

(58) Field of Classification Search ..... 362/417, 362/410, 412, 414

See application file for complete search history.

(56) References Cited

U.S. PATENT DOCUMENTS

| | | | | |
|---|---|---|---|---|
| 1,994,410 | A * | 3/1935 | Texier | 362/394 |
| 5,412,554 | A * | 5/1995 | Lee | 362/449 |
| 6,971,773 | B2 * | 12/2005 | Pape et al. | 362/417 |
| 2002/0154508 | A1 * | 10/2002 | Wu | 362/413 |
| 2005/0276055 | A1 * | 12/2005 | Bauer | 362/417 |
| 2008/0310170 | A1 * | 12/2008 | Dorr et al. | 362/319 |

* cited by examiner

*Primary Examiner* — Evan Dzierzynski
(74) *Attorney, Agent, or Firm* — William A. Jeckle

(57) ABSTRACT

An adaptor or an original lamp. The adaptor is used with a lamp having a light bulb to better mount a loop-type lamp shade thereon. The adaptor has a harp assembly with harp sections that extend from a mounting ring or collar that fits about the head of the lamp. The collar can be eliminated when the apparatus is built in to the lamp head during manufacture. The adapter allows support of the lamp shade by both the loops and using a harp to thus reduce tilting or other disorientation of the lamp shade.

13 Claims, 7 Drawing Sheets

LAMPS AND HARP ADAPTOR APPARATUSES FOR USE WITH LOOP LIGHT SHADES

RELATED APPLICATION DATA AND PRIORITY INFORMATION

This application claims priority to U.S. Provisional Patent Application Ser. No. 61/135,065, filed Jul. 16, 2008.

BACKGROUND

Lamps and light fixtures often have shades used therewith to soften the light emitted into the room or other surrounding area. Light shades are frequently adjusted by homeowners in a seemingly never-ending quest to achieve a level or other angle of orientation which seems correct to the owner.

The tilting of lamp shades can be caused by people touching the shades when turning the lamp or fixture on or off. It also occurs when people accidentally bump into shades and are either unaware of or ignore their movement and disorientation of the shade.

Another possible cause for the high frequency that homeowners experience in needing to adjust the orientation of lamp shades is the constant temblors that go unnoticed due to stress waves passing through the earth. These may be generated by earthquakes, volcanos, tectonic plate movement that does not rise to the level of being considered an earthquake by most people, and for other reasons which my or may not be fully understood.

Another possible reason that shades seemingly are in need of frequent adjustment to achieve a level or other desired orientation is due to home or building movements associated with wind forces. Although these typically go unnoticed by most people except during violent storms, wind loading on a structure causes minute displacements which can cause lamp shades to become disoriented.

The problems with disoriented lamp shades may be caused by other effects, but whatever the cause they are frequently an annoyance to homeowners, building maintenance people or others.

In some installations lamp shades are easily reoriented to a level or other desired orientation. Table lamps are easily accessible and also relatively convenient to adjust despite the seeming frequency at which such is needed. Other types of installations may pose significantly greater problems for the adjustment of lamp shades. For example, chandeliers are in many installations not easily accessible. The chandelier light fixture may be hung not only above a dining table but also in hallways and other locations where they are high in elevation during normal use. In many instances the ceilings are particularly high where chandeliers are installed. Such locations may pose particular inconvenience when lamp shades are used on the lights.

Lamp shades have been widely made using two different types of construction. One type uses a harp that loops over the light bulb and has an attachment to the lamp base at each side. These harp lamp shade mounts typically snap into receivers at the bottom along each side of the light bulb receptacle. Harps are continuous and usually have some small piece attached in the middle at the top. Harp shade mounts usually have pieces which swivel about the circular cross section of the harp to allow tilt adjustment in one direction. Other connections have also been used and connected along the top section of the harp.

Another common form of mounting for lamp shades use two opposing loops of wire which are shaped and sized to fit directly onto the glass of the light bulb. This type of shade mount are economic but suffer an even greater propensity for disorientation for the reasons noted above or other reasons. The loops are merely held in place by friction and need adjustment of the loops to provide increased friction. They also tend to become misshapen if dropped and in general have been considered more difficult to use and maintain the shade in the desired orientation.

Thus, there is a continuing and long-felt need for lamps and lamp shades that are designed and made in a manner which resists disorientation. This has proven even more difficult with light shades using loop-type mounts which attach by slipping them onto a light bulb.

Some or all of the problems explained above and other problems may be helped or solved by one or more embodiments of the inventions shown and described herein. Such inventions may also be used to address other problems not set out above or which are only understood or appreciated at a later time. The future may also bring to light currently unknown or unrecognized benefits which may be appreciated or more fully appreciated in association with the inventions shown and described herein.

It should be recognized that the needs and expected benefits explained hereinabove are not admissions that others may have recognized such problems prior to the inventions described herein and thus are not admitted as prior art.

BRIEF DESCRIPTION OF THE DRAWINGS

Preferred forms, configurations, embodiments and/or diagrams relating to and helping to describe preferred aspects and versions of the inventions are explained and characterized herein, often with reference to the accompanying drawings. The drawings and all features shown therein also serve as part of the disclosure of the inventions of the current document, whether described in text or merely by graphical disclosure alone. Such drawings are briefly described below.

DETAILED DESCRIPTION

Figure 1:
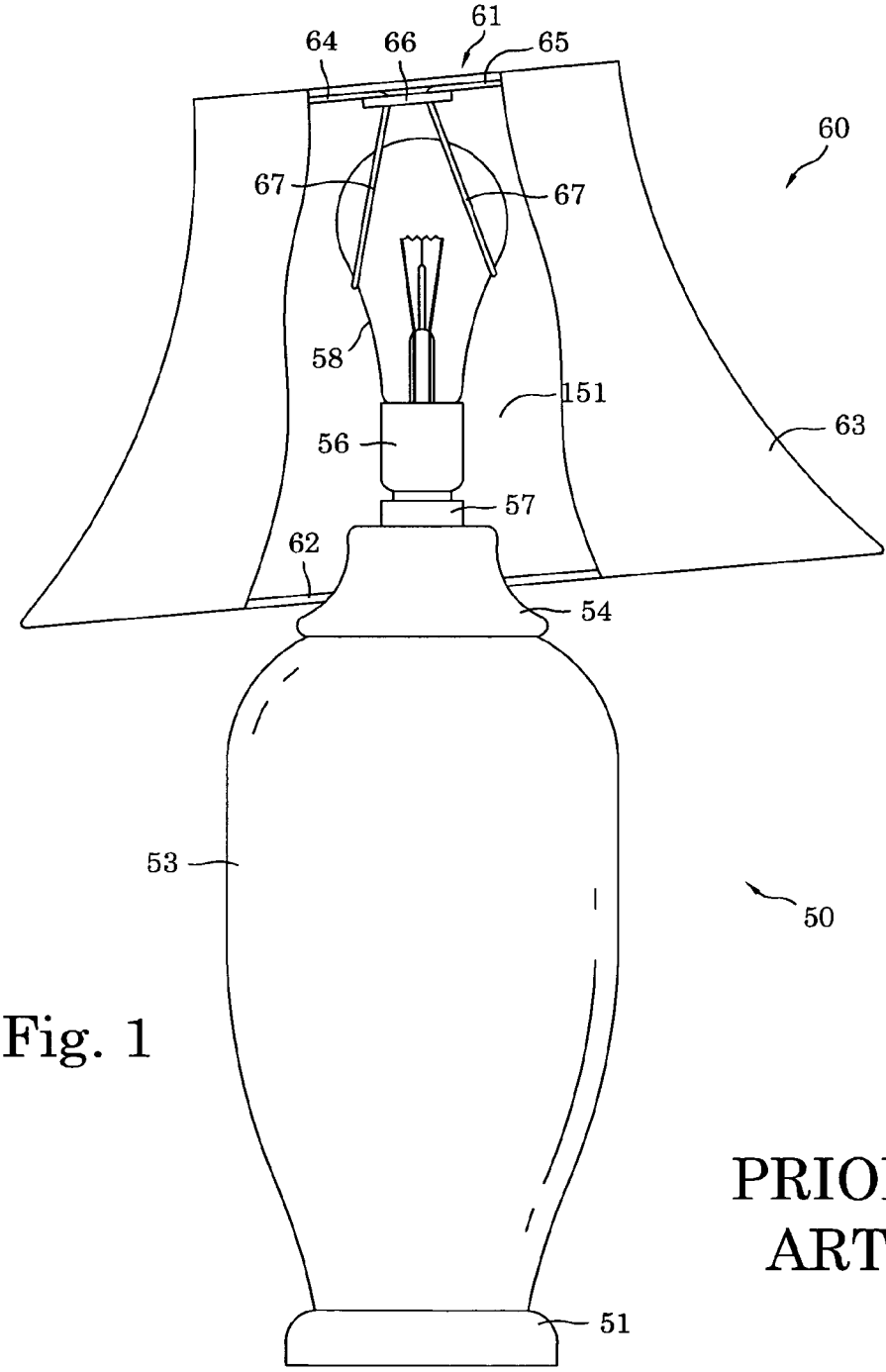
Fig. 1 PRIOR ART
FIG. 1 is front elevational view of a prior art lamp fitted with a loop-style lamp shade. Portions of the lamp shade have been broken away to better illustrate the loop-style mount.

A table of sections of this detailed description follows.

TABLE OF DETAILED DESCRIPTION SUBSECTIONS

INTRODUCTORY NOTES
OVERVIEW
LAMP
LOOP-STYLE LAMP SHADE
APPARATUSES AND KITS
HARP ASSEMBLY
HARP SECTIONS
HEADPIECE
ADAPTER ASSEMBLY
METHODS AND USE
SECOND EMBODIMENT
THIRD EMBODIMENT
FOURTH EMBODIMENT
INTERPRETATION NOTES

DETAILED DESCRIPTION OF THE INVENTIONS

Introductory Notes

The readers of this document should understand that the embodiments described herein may rely on terminology used in any section of this document and other terms readily apparent from the drawings and the language common therefor as may be known in a particular art and such as known or indicated and provided by dictionaries. Dictionaries were used in the preparation of this document. Widely known and used in the preparation hereof are Webster's Third New International Dictionary (© 1993), The Oxford English Dictionary (Second Edition, © 1989), and The New Century Dictionary (© 2001-2005), all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text and meaning of the claims and abstract are hereby incorporated by reference into the description in their entirety as originally filed. Terminology used with one, some or all embodiments may be used for describing and defining the technology and exclusive rights associated herewith.

The readers of this document should further understand that the embodiments described herein may rely on terminology and features used in any suitable section or other embodiments shown in this document and other terms readily apparent from the drawings and language common or proper therefor. This document is premised upon using one or more terms or features shown in one embodiment that may also apply to or be combined with other embodiments for similar structures, functions, features and aspects of the inventions and provide additional embodiments of the inventions.

Overview

The inventions according hereto may include converters for use on lamps and light fixtures to help maintain a stable lamp shade. In particular, the converters include several pieces forming an assembly which may be provided as a kit which converts a lamp using a loop-mounted lamp shade into an improved mounting configuration.

Inventions according hereto also include light bulb bases or fixtures forming an apparatus or that form a kit having a multiple piece harp which has distal portions which are connected to provide a mount onto which a loop-mounted lamp shade may be installed and stabilized against disorientation.

Lamp

Many lamp shades have been and are currently built in a style having loops that engage the light bulb. This is explained above and is illustrated in FIG. 1 which will now be described in greater detail with regard to the illustration of FIG. 1.

As FIG. 1 shows, there is a lamp 50 which may be of various styles and materials of construction. As shown, lamp 50 has a base 51 which supports a lamp body 53. The lamp body 53 is advantageously provided with a shoulder 54 which is merely just a feature of the lamp portrayed.

FIG. 1 also shows that lamp 50 includes a neck 57 which mounts the lamp socket 56. A bulb 58 is screwed into or otherwise suitably installed in the socket 56.

Loop-Style Lamp Shade

FIG. 1 also shows the lamp shade assembly or merely lamp shade 60 mounted upon the light bulb 58. This is done with loop-type shade 60 using the upper part of the shade frame 61 which is joined to the lower shade frame part 62 using frame arms (not shown). The shade covering 63 extends over the sides or slant of the shade between the upper and lower frame parts.

Figure 2:
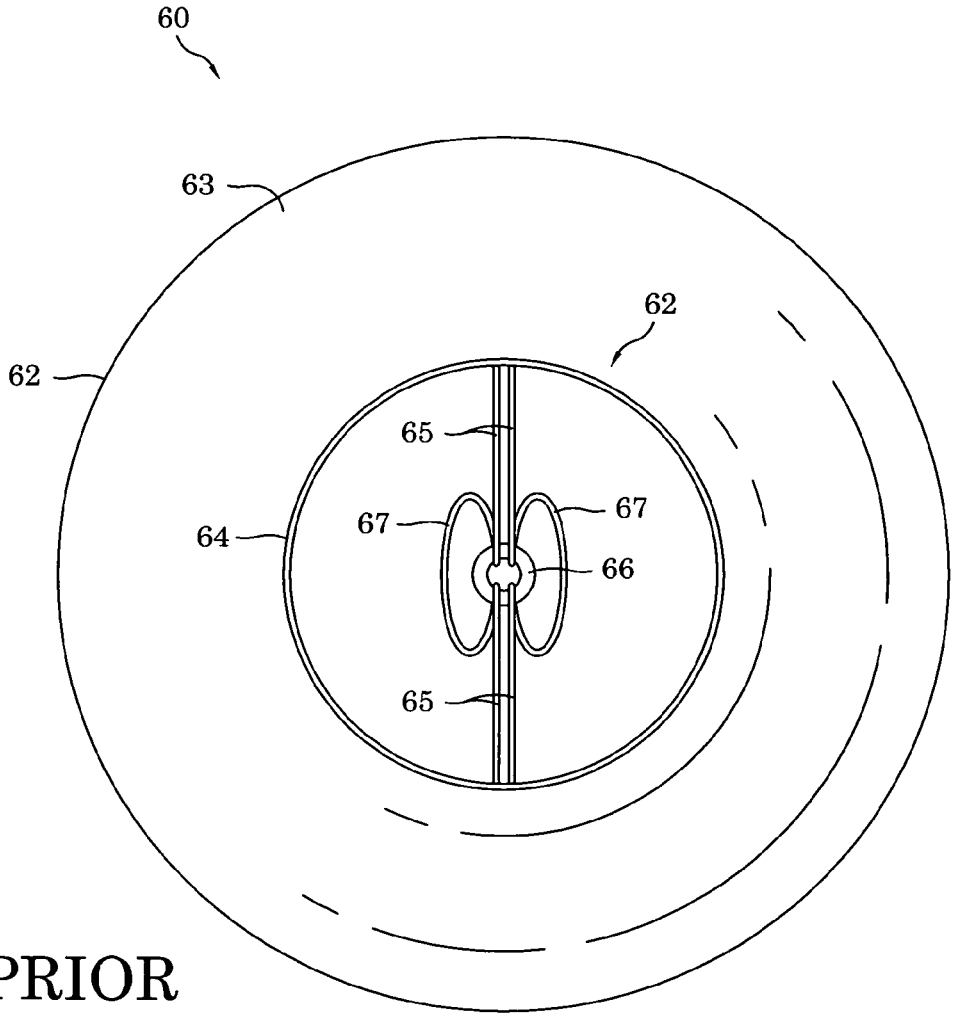
PRIOR ART Fig. 2
FIG. 2 is a top view of the loop-style lamp shade used in FIG. 1 viewed in isolation.

FIG. 2 shows the upper frame part 62 in greater detail. The upper frame part 62 includes a peripheral ring 64. Extending across the top opening is a pair of wires or rods 65. The rods are, in this design, shaped to drop through a mounting ring 66. The dropped sections of rods 65 are formed into loops 67 which engage opposing sides of the light bulb (see FIG. 1). As suggested in FIG. 1 these loop-style lamp shades are prone to tilting or other disorientation.

Apparatuses and Kits

Figure 3:
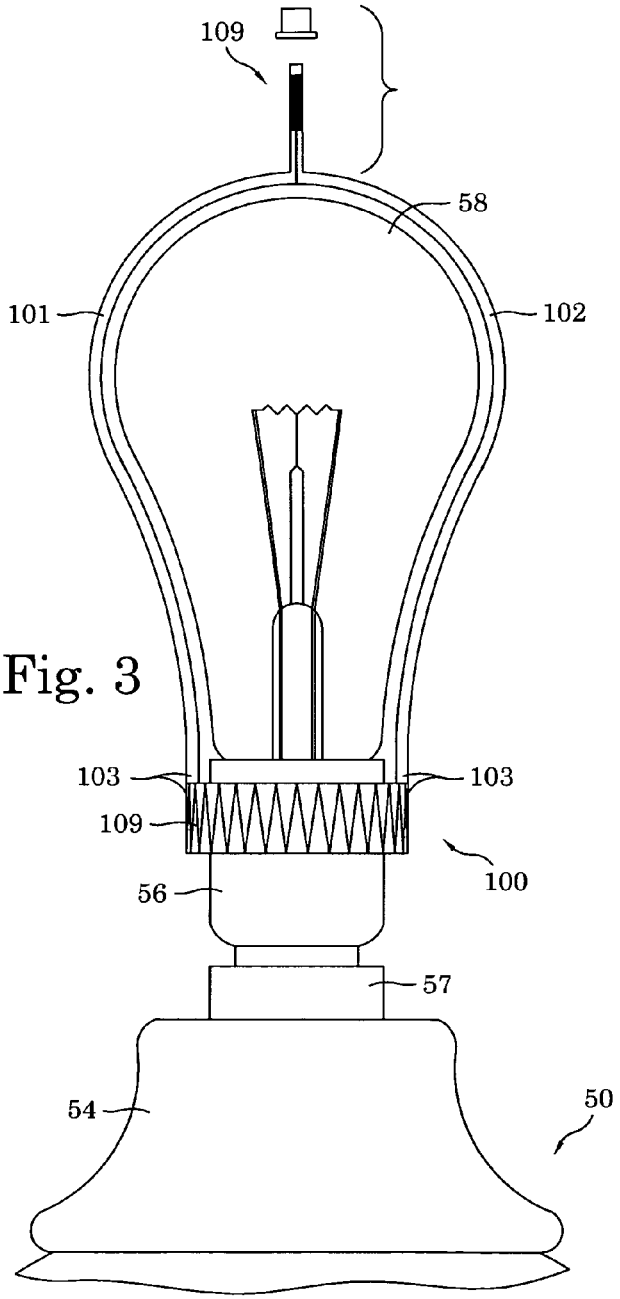
FIG. 3 is a front view of portions of a lamp and parts of a first embodiment apparatus according to the inventions hereof.

FIG. 3 shows a first embodiment 100 according to the inventions installed upon upper portions of an electric lamp. Apparatus 100 may be provided or sold in a kit including the various parts which are assembled into the apparatus 100. Alternatively, the lamp may have features of the inventions described herein provided during original manufacture.

Harp Assembly

As illustrated, the lamp shade mount 100 has a harp assembly 103 having a base ring 109 which is used on cylindrical sections of the lamp socket 56 or other suitable parts of the lamp neck or adjacent thereto. The base ring is preferably constructed so as to allow some variation or can be sized to fit a conventional standard. Variation may be provided in the forms of a split ring or interlacing fingers types of adjustable joint (not illustrated).

Harp Sections

Extending upwardly from the base ring 109 are harp sections 101 and 102. The connection between the base ring and harp sections may be by convention metal brazing or welding and other suitable techniques.

First harp section 101 extends up and is preferably suitably shaped to go around or along light bulb 58. A variety of shapes are suitable and may be affected by other aspects of the lamp, bulb or shade.

The first harp section is advantageously made with a stud part 104. In the construction shown, stud part 104 has a top part 105 which extends over a portion or all of the second harp section stud part 106 to provide axial positioning. Both parts 104 and 106 are advantageously provided with a connection feature or features. As illustrated this is done using threads 107 and 108. The threaded sections are also preferably shaped to mate so that a connector extending about the stud sections will bring secure mechanical connection with the connection piece 110 joining the connection.

Headpiece

Figure 4:
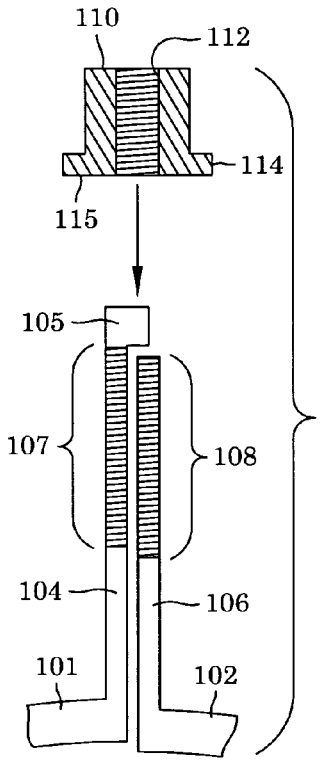
FIG. 4 is an enlarged detail front view of the top pieces used in the apparatus shown in FIG. 3.

FIG. 4 also shows a preferred part of the assembly and kit in the form of a connection piece or part 110. Connection part 110 acts in this situation to adjoin and connect the illustrated three elements into an assembly when part 110 is installed onto the adjoining stud portions of the plural harp sections. As shown, connection is provided by a headpiece 110 which advantageously has a central passage which in this case is provided with an interiorly threaded wall 112. A flange 115 is also preferably included and can have features thereon (not shown in FIG. 4) which facilitate engagement and connection of the two harp sections.

Adapter Assembly

Figure 5:
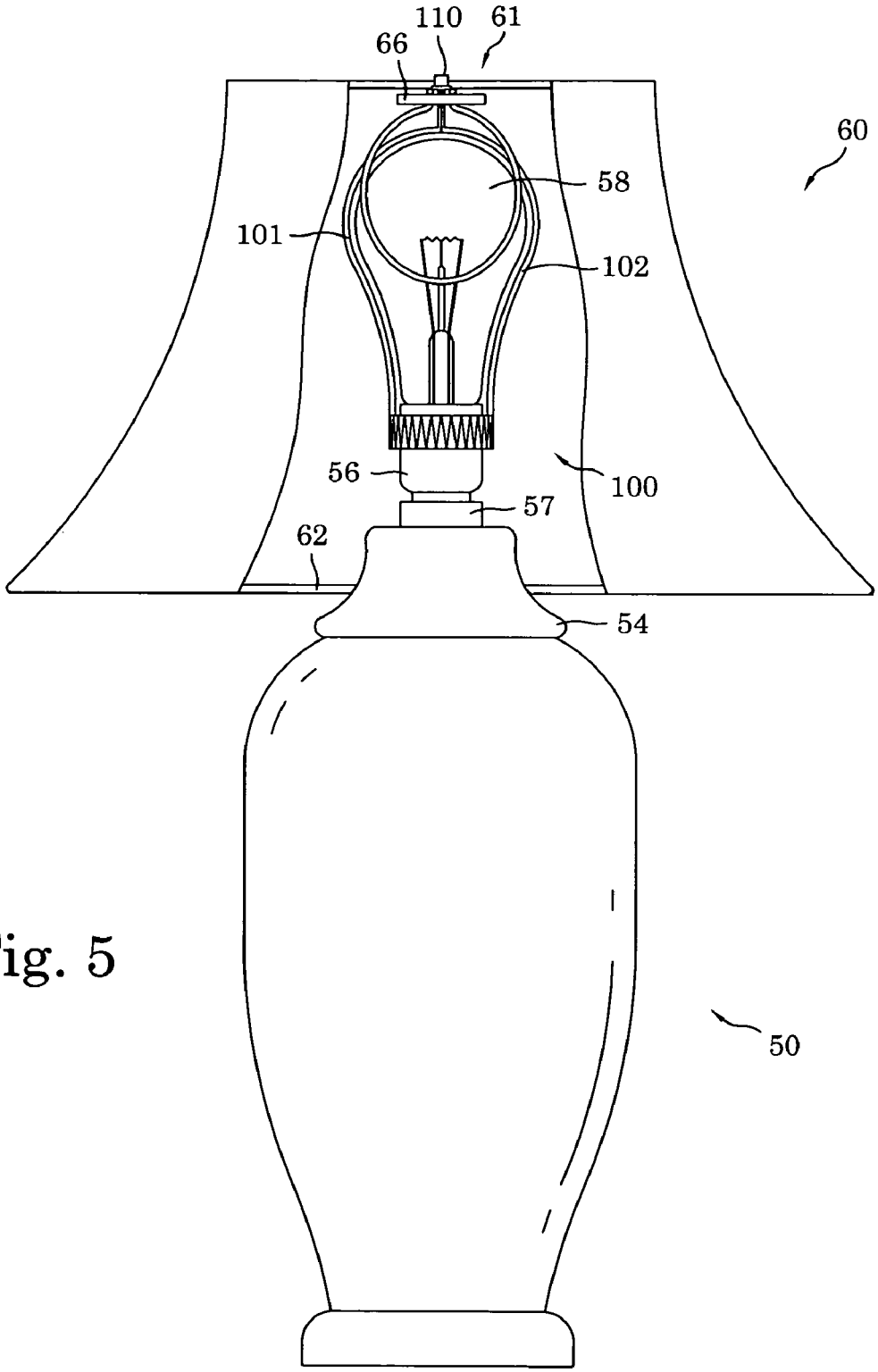
FIG. 5 is a front view of the lamp of FIG. 1 fitted with the first embodiment apparatus illustrated in FIGS. 3 and 4 to provide an improved stability lamp shade mounting.

FIG. 5 shows the adapter or converter 100 installed and the shade 60 mounted to the lamp 50. This provides a novel lamp assembly. The resulting lamp assembly has a connection through or engaged to lamp mount ring 66. The stud parts 104 and 106 are inserted into the central aperture of ring 66 or otherwise connected to the lamp connection subassembly. The headpiece 110 is threaded or otherwise suitably connected to the harp sections as at stud parts 104 and 106. The headpiece is then advantageously threaded onto the mating stud parts and advances into an engagement position wherein the headpiece compresses the ring 66 against upper parts of the harp sections which are placed into juxtaposition at the stud formed after adjoinment and assembly provides a secure joinder of the lamp in two different ways. One via the lamp engaging side loops 67 and the other is via the apparatus 100. As illustrated the hoops are installed to not interfere with the harp sections in most utilizations by people on various lamps. The various lamps may be new or in various used conditions which may in some cases effect how the adapter is used.

Methods and Use

Figure 6:
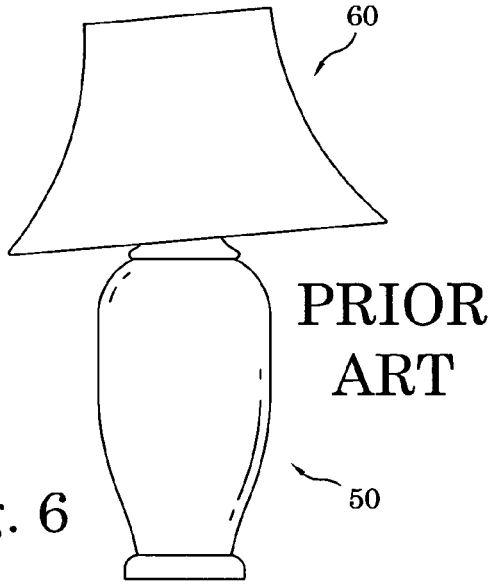
FIG. 6 shows the first step in an installation sequence wherein the lamp of FIG. 1 is in a prior art condition.

FIGS. 6-10 illustrate some preferred methods according to the inventions and preferred manners of use. In particular, FIG. 6 shows lamp 50 and shade 60 as in FIG. 1. Shade 60 is tilted and disoriented as is often the situation. Shade 60 is fitted with the mounting loops 67 at this point and has not been adapted.

Figure 7:
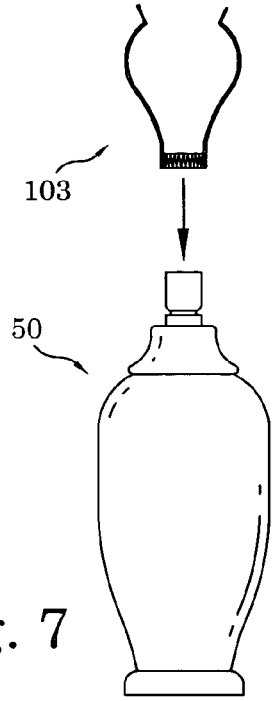
FIG. 7 shows a step subsequent to FIG. 6 where the shade has been removed and the harp assembly of FIG. 3 is being installed upon the lamp.

FIG. 7 shows several steps having taken place. Installation is typically started by removing the shade 60 by lifting or otherwise displacing the shade so that the loops 67 are removed by sliding the loops off the light bulb. This serves by disengaging the lamp from the bulb and attached lamp or other light fixture.

Figure 8:
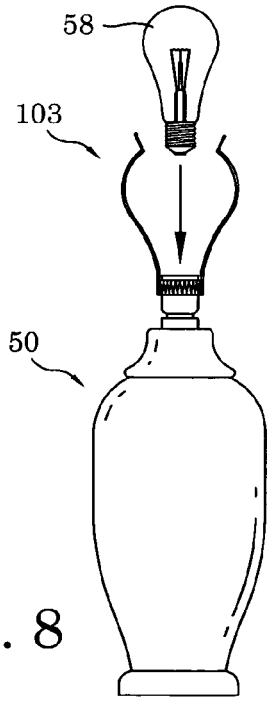
FIG. 8 shows a step subsequent to FIG. 7 wherein the electric light bulb is being installed into the lamp socket in position between the harp assembly of FIG. 3 and others according to the inventions hereof.

FIG. 7 also indicates that installing of the adaptor preferably involves removing the light bulb 58 (not shown in FIG. 7, see FIGS. 3 and 8). The harp assembly is then acted upon by installing it on the head of the lamp as indicated in FIG. 7. This is preferably done by sliding it axially onto the outer surfaces of the lamp socket 56 or other portions of the lamp head adjacent thereto.

If the collar portion 109 of the harp assembly is so constructed then it performs by adjusting to the size of the socket 56 or other part onto which it is being installed by sliding and expanding or contracting depending on the particular installation and sizes of the parts which are engaging to effect mounting of the split harp assembly.

FIG. 8 shows the installing of bulb 53 into the bulb socket in the typical fashion, such as by inserting and turning the bulb to thereby perform screwing of the light bulb into the socket. Alternatively, the installing of the bulb into the lamp socket may be performed as otherwise required by the bulb and socket is constructed and designed differently than a screw-in socket, e.g. bayonet or other mounts which may have been used or are being used, or if the lamp is being constructed anew.

Figure 9:
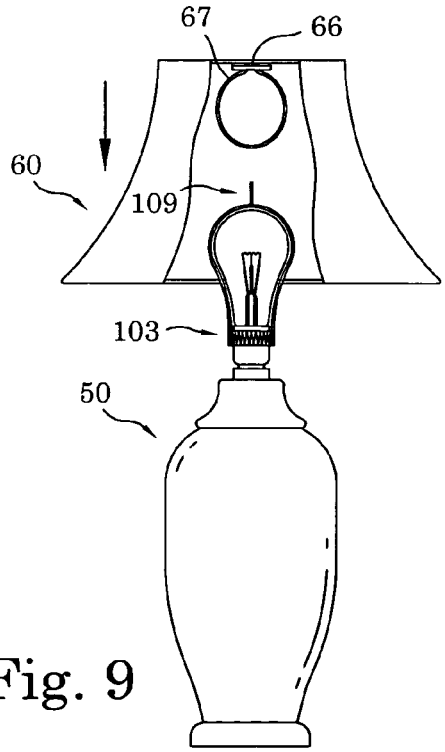
FIG. 9 shows a step subsequent to FIG. 8 wherein the loop-type lamp shade is being installed onto the lamp fitted with the novel apparatus according to the inventions.
Figure 10:
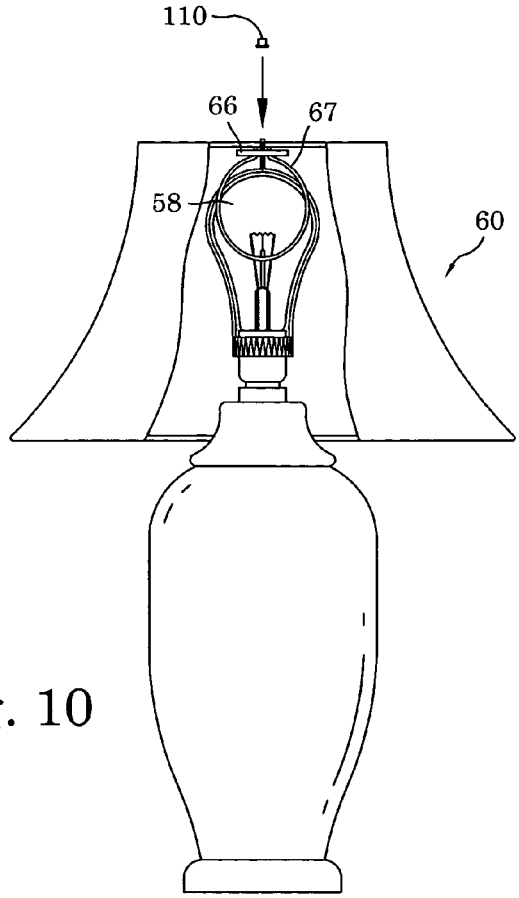
FIG. 10 shows a step subsequent to FIG. 9 wherein the loop-type lamp shade is installed onto the lamp and harp assembly and the securement piece is ready to be fitted onto the novel harp assembly to secure the lamp shade.

FIG. 9 shows the loop-type lamp shade (with portions broken way for better illustration) being installed by axially aligning the loops with the bulb. The installing of the shade is preferably done with the loops positioned to install onto the light bulb along opposite sides and needing contact with harp sections until the ring 66 of the shade is positioned by placing the ring over the harp sections which have been adjoined into the condition illustrated in FIG. 3 and FIG. 9. The resulting harp assembly stud 109 is then joined with the lamp shade by inserting the conjoined stud 109 into ring 66.

After the shade has been so positioned, then the shade is preferably completely installed by threading the retainer 110 onto the stud assembly and applying some compressive forces thereby both tightening the ring against the loops 67 and tightening the retainer onto the harp assembly as threading or otherwise advancing and tightening the retainer onto the stud of the harp assembly and thereby tightening and securing the lamp shade 60 onto the adapted lamp.

Second Embodiment

Figure 11:
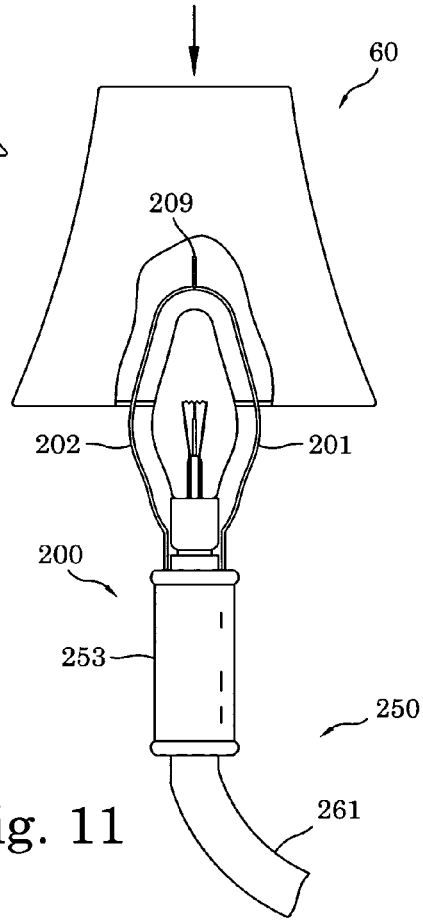
FIG. 11 is a front view of an alternative embodiment wherein the novel apparatus is incorporated into a chandelier and a single chandelier lamp on a portion of a chandelier arm are illustrated.

FIG. 11 illustrates a second embodiment apparatus 200 according to the inventions. Apparatus 200 is part of a chandelier 250 (not fully shown) which has an arm 261 and a lamp holder 250. Lamp holder 250 has a lamp holder body 253 akin to the lamp body 53 of FIG. 1.

The chandelier lamp holder is specifically manufactured to have the capabilities described above with regard to the adapter apparatus 100 of the first embodiment and similar numbers are used except with reference numbers in the 200's as compared to the 100's. Otherwise the construction is similar and parts of the shade are numbered the same as shade 60.

One noteworthy difference is that the two harp sections may alternatively be mounted to facilitate spreading them apart by having a flexible connection with the lamp body 253.

Another alternative construction embodied in the fixture is that the adjoining the harp sections 201 and 202 may be provided without the equivalent of the end piece 105 to simplify manufacture.

Otherwise the chandelier lamp fixture is similar or the same as described above with regard to the first embodiment.

Third Embodiment

Figure 12:
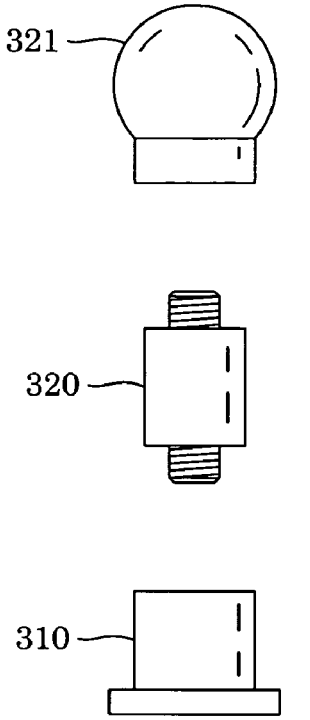
FIG. 12 is an enlarged exploded view of another embodiment according to the inventions.
Figure 12:
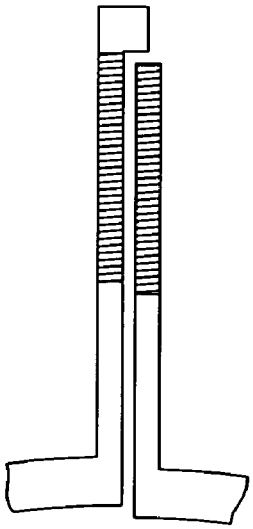

FIG. 12 shows portions of a third embodiment 300 wherein the adapter is provided with an extension 310 which acts as the retainer. The retainer also acts as an extension and can be fitted with a threaded extension piece 320 upon which are mounted a finial 321 of desired size and style.

Fourth Embodiment

Figure 13:
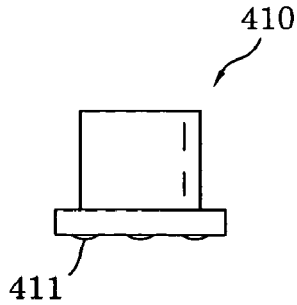
FIG. 13 is an enlarged cross-sectional view of the securement piece of FIG. 12.
Figure 14:
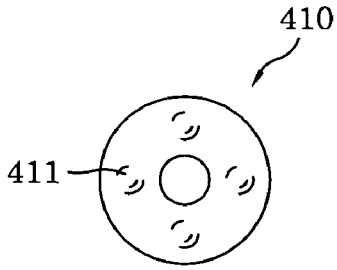
FIG. 14 is a bottom view of the securement piece of FIG. 12.

FIG. 13 shows a retainer 410 similar to 110 except it is provided with texturizing 411 upon the bottom surface. This may be done by scoring, molding features into the piece or otherwise providing features which help to additionally secure or lock the retainer into position after it is tightened and the texture features engage with the adjacent parts of the lamp shade central ring 66 and/or the shade mount strands 65. The particular type of texture desired may vary in a number of ways depending on the shade construction against which it engages.

Interpretation Notes

The above description has set out various features, functions, methods and other aspects of the inventions. This has been done with regard to the currently preferred embodiments thereof. Time and further development may change the manner in which the various aspects are implemented. Such aspects may further be added to by the language of the claims which are incorporated by reference hereinto as originally filed.

The scope of protection accorded the inventions as defined by the claims is not intended to be necessarily limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

We claim:

1. An apparatus for use in supporting a loop-type lamp shade, comprising:

a first harp section;

a second harp section;

a connector having the first and second harp sections extending therefrom;

a harp section joiner for joining the first and second harp sections;

at least one connection stud portion for being received into a mounting receptacle of a loop-type lamp shade, the at least one connection stud portion having a first stud portion on the first harp section and a second stud portion on the second harp section;

a removable retainer which is secured to the at least one connection stud portion to hold said loop-type lamp shade; and said first and second harp sections being adapted to be in adjoining relationship when assembled to receive the removable retainer thereon.

2. An apparatus according to claim 1 wherein: the at least one connection stud portion includes a first stud portion on the first harp section and a second stud portion on the second harp section, said first and second harp sections being adapted to be in adjoining relationship with at least one axial engagement feature when assembled to receive the removable retainer thereon.

3. An apparatus according to claim 1 wherein: the connector is adapted to fit about a portion of a head of a lamp.

4. An apparatus forming a lamp for use with a loop-type lamp shade, comprising:

a lamp having a head portion with a light bulb socket;

a first harp section;

a second harp section;

a harp section joint at which the first and second harp sections are adapted to be joined;

at least one connection stud portion for being received into a mounting receptacle of a loop-type lamp shade, the at least one connection stud portion having a first stud portion on the first harp section and a second stud portion on the second harp section;

a removable retainer which is secured to the at least one connection stud portion to hold said loop-type lamp shade; and said first and second harp sections being adapted to be in adjoining relationship when assembled to receive the removable retainer thereon.

5. An apparatus according to claim 4 wherein: the at least one stud portion includes a first stud portion on the first harp section and a second stud portion on the second harp section, said first and second harp sections being adapted to be in adjoining relationship with at least one axial engagement feature when assembled to receive the removable retainer thereon.

6. An apparatus according to claim 4 wherein: the connector is adapted to fit about a portion of a head of a lamp.

7. An apparatus according to claim 4 and further comprising: a loop-type lamp shade connected to the lamp at said at least one connection stud wherein the connector is adapted to fit about a portion of a head of a lamp.

8. An apparatus according to claim 4 and further comprising: at least one connection stud extension.

9. An apparatus according to claim 4 and further comprising: at least one connection stud extension and a finial connected thereto.

10. A method for converting a lamp to provide improved mounting of a loop-type lamp shade to the lamp, comprising:

selecting a harp assembly having a plurality of harp sections which are spaced apart and adapted to be joined at upper portions thereof, said harp assembly also being adapted to be mounted upon a head of the lamp adjacent a light bulb socket and having at least one stud extension part;

installing the harp assembly upon a lamp being converted;

placing a light bulb into the lamp light bulb socket;

adjoining the plurality of harp sections;

supporting a loop-type lamp upon the at least one stud extension part;

engaging loops of the loop-type shade upon the lamp light bulb held in the lamp light bulb socket;

securing a retainer onto the at least one stud extension part to secure the loop-type lamp shade to the harp assembly and lamp; and the adjoining the plurality of harp sections includes bringing at least two of said at least one stud extension part into adjoining relationship.

11. A method according to claim 10 wherein: the adjoining the plurality of harp sections includes bringing at two of said at least one stud extension part into adjoining relationship, said two stud extensions having a feature for axially positioning.

12. A method according to claim 10 and further comprising: extending the retainer.

13. A method according to claim 10 and further comprising: extending the retainer and installing a finial thereon.

* * * * *